US005385418A

United States Patent [19]

Hsieh

[11] Patent Number: 5,385,418

[45] Date of Patent: Jan. 31, 1995

[54] CLAMPING PEN

[76] Inventor: Jung-Jen Hsieh, No. 6, Alley 15, Lane 670, Chung-Shan Rd., Kuei-Jen Hsiang, Tainan Hsien, Taiwan, Prov. of China

[21] Appl. No.: 177,389

[22] Filed: Jan. 5, 1994

[51] Int. Cl.[6] ..... B43K 21/22

[52] U.S. Cl. ..... 401/92; 401/82; 401/104

[58] Field of Search ..... 401/104, 105, 106, 92, 401/82, 84

[56] References Cited

U.S. PATENT DOCUMENTS

| | | | |
|---|---|---|---|
| 9,902 | 10/1881 | Hoffman | 401/92 |
| 937,815 | 10/1909 | Knapp | 401/92 |

FOREIGN PATENT DOCUMENTS

| | | | |
|---|---|---|---|
| 39383 | 9/1886 | Germany | 401/92 |
| 827803 | 2/1960 | United Kingdom | 401/92 |

*Primary Examiner*—Steven A. Bratlie
*Attorney, Agent, or Firm*—Bacon & Thomas

[57] ABSTRACT

A clamping pen composed of a clamping tube receiving a core rod member and a clip member extending outward from the clamping tube. The clamping tube has an upper open end and a lower end. The upper end is formed with multiple annular projections and two lateral axially extending slots or fissures. A flange is formed on the clamping tube below the clip member, serving as a fulcrum, whereby when the clip member is pressed down or released, the fissures are expanded or contracted, permitting the rod member received in the clamping tube to be easily moved outward or inward to adjust a protruding length of the rod member. After the adjustment is completed, the clip member is released and the annular projections of the clamping tube are tightly held to contract the fissures and tightly clamp the rod member for easy use.

8 Claims, 3 Drawing Sheets

CLAMPING PEN

BACKGROUND OF THE INVENTION

1. Field of the Invention

The present invention relates to a clamping pen, and more particularly to a clamping pen composed of a clamping tube having a fissured or slotted upper open end and a clip member extending outward from the clamping tube. The clamping tube is suitable to receive and clamp a cylindric rod-like article such as a rubber eraser, a chalk, a charcoal, etc. When pressing the clip member, the fissured upper end of the clamping tube is expanded to loosen the rod-like article for adjusting a protruding length thereof.

2. Description of the Prior Art

A conventional eraser pen includes a core eraser wrapped by a roll of paper. When using such eraser pen, a part of the wrapping paper must be first torn away to expose a part of the inner eraser and after this part of eraser is used up, another part of the wrapping paper must be further torn away to expose another part of the eraser. It is difficult to manufacture such an eraser pen and it is inconvenient to use such an eraser pen.

On the other hand, the currently used chalk is used in such a manner that a user must hold the chalk with a hand to write on a black board. The lime component of the chalk is apt to attach to the hand of the user and cause skin disease. Some people use finger sections of a glove as a protecting cover when using the chalk. This is troublesome and makes the heat of the fingers of the user difficult to dissipate. Such condition is likely to cause sudamina or eczema. Those who often use a crayon or a charcoal, such as a painter or an artist, will meet such problems as well. Especially, the crayon is made from petrochemical material and will cause more serious detriment to the environment and the human body than the chalk.

Therefore, it is necessary to provide an improved clamping pen which can clamp various rod-like articles to avoid direct contact between the human hand and the article so as to eliminate the above shortcomings existing in prior art.

SUMMARY OF THE INVENTION

It is a primary object of the present invention to provide a clamping pen capable of easily and conveniently clamping various rod-like members to facilitate the use thereof.

It is a further object of the present invention to provide a clamping pen which can avoid direct contact between a user's hand and the rod-like member and thus protect the user's hand from being contaminated and skin disease.

It is still a further object of the present invention to provide a clamping pen which enables the user to totally use the rod-like member without waste.

According to the above objects, the clamping pen of the present invention is composed of a clamping tube receiving a core rod member and a clip member extending outward from the clamping tube. The clamping tube has an upper open end and a lower end. The upper end is formed with multiple annular projections and two lateral axial slots or fissures. A flange is formed on the clamping tube below the clip member, serving as a fulcrum, whereby when the clip member is pressed down or released, the fissures are expanded or contracted, permitting the rod member received in the clamping tube to be easily moved outward or inward to adjustably set a protruding length of the rod member. After the adjustment is completed the clip member is released and the annular projections of the clamping tube are tightly held to contract the fissures and tightly clamp the rod member for easy use.

The present invention can be best understood through the following detailed description and accompanying drawing, wherein:

DETAILED DESCRIPTION OF THE PREFERRED EMBODIMENTS

Figures 1, 1A, 2:
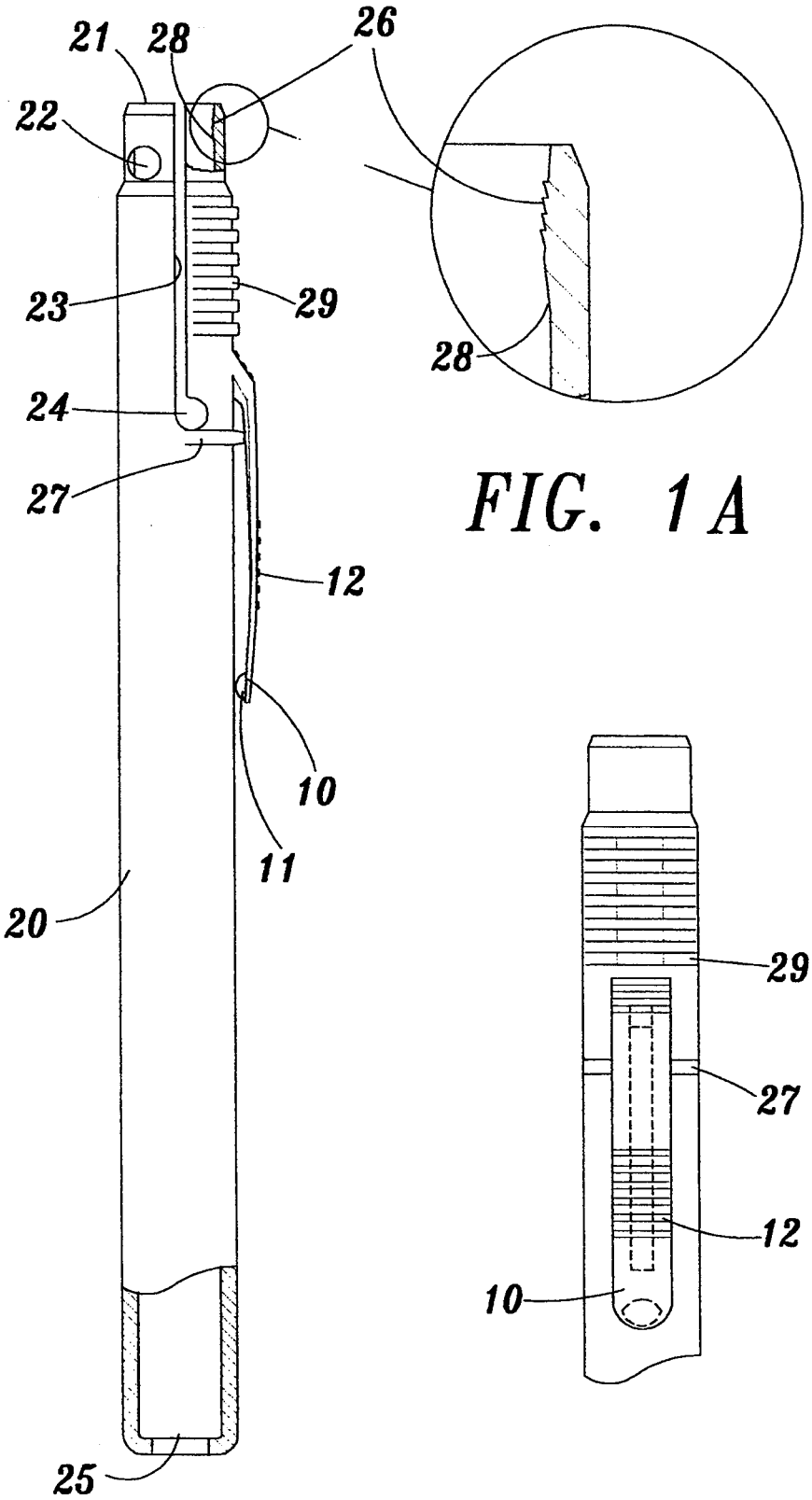
FIG. 1 is a side view of the present invention.
FIG. 1A is an enlarged view of the circled portion in FIG. 1 showing the stopper block and saw teeth.
FIG. 2 is a front view of the present invention.

The present invention, as shown in FIGS. 1 and 2, includes a clamping tube 20 having an upper open end 21 and a lower end formed with an opening 25. The upper end 21 has an inner diameter slightly smaller than an outer diameter of a core rod member 30 received in the clamping tube 20. In addition, the upper end 21 is formed with multiple annular projections 29 and two lateral axial open-ended slots or fissures 23, each terminating in a lower enlarged hole 24. The clamping tube 20 has a resilient clip member 10 extending outward from a position right above the lower holes 24 of the fissures 23. The clip member 10 serves to secure the clamping pen to a pocket of a user. The clip member 10 is formed with slideproof projecting stripes 12 and has a thickness tapered from a fixed end joining the clamping tube 20 above the holes 24 to a free semispheric end 11 abutting against the clamping tube 20 so that the clip member 10 is quite resilient. A semicircular flange 27 is formed on the clamping tube 20 right below the lower holes 24 of the fissures 23 behind the clip member 10. The flange 27 serves as a fulcrum while the clip member 10 serves as a forcing point, whereby when a user presses down on the slideproof projecting stripes 12 of the clip member 10, according to the Principle of Lever of the First Order whereby the fulcrum is between the forcing point and the resisting point, the fissure 23 can be easily expanded. At this time, the rod member 30 received in the clamping tube 20 may be easily moved outward or inward to adjust the external protruding length of the rod member 30.

After the external protruding length of the rod member 30 is adjusted, the user then compresses the annular projections 29 of the clamping tube 20 to contract the fissure 23 and tightly clamp the rod member 30. The upper end 21 of the clamping tube 20 is further formed with an assistant clamping hole 22 and an inner stopper block 28 having reverse saw teeth 26, whereby when the rod member 30 is of soft material and compressed by the fissured upper end 21 of the clamping tube 20, a part of the rod member 30 will be extruded into the assistant clamping hole 22 and the saw teeth 26 of the upper end 21 of the clamping tube 20. As shown in FIG. 1A, the saw teeth 26 of the stopper block 28 bite the rod member 30 and the stopper block 28 forces the rod member 30 inward against an opposite inner wall of the clamping tube 20 so that the rod member 30 is tightly held by the clamping tube 20 and prevented from dropping out. The diameter of a section below the annular projections 29 of the clamping tube 20 is reduced so that the user can easily determine the current position of the rod member 30. When the diameter of the rod member 30 is similar to the inner diameter of the clamping tube 20, the air therein is not easily discharged and a resistance against the loading or adjustment of the rod member 30 will be created. For improving this, the opening 25 of the lower end of the clamping tube 20 serves to ventilate the air therein so as to facilitate the inward/outward moving of the rod member 30. An additional fissures 23 can also be formed on the upper end 21 of the clamping tube 20, making the upper end 21 contract inward to more firmly clamp the rod member 30.

Figures 3A, 3B, 3C:
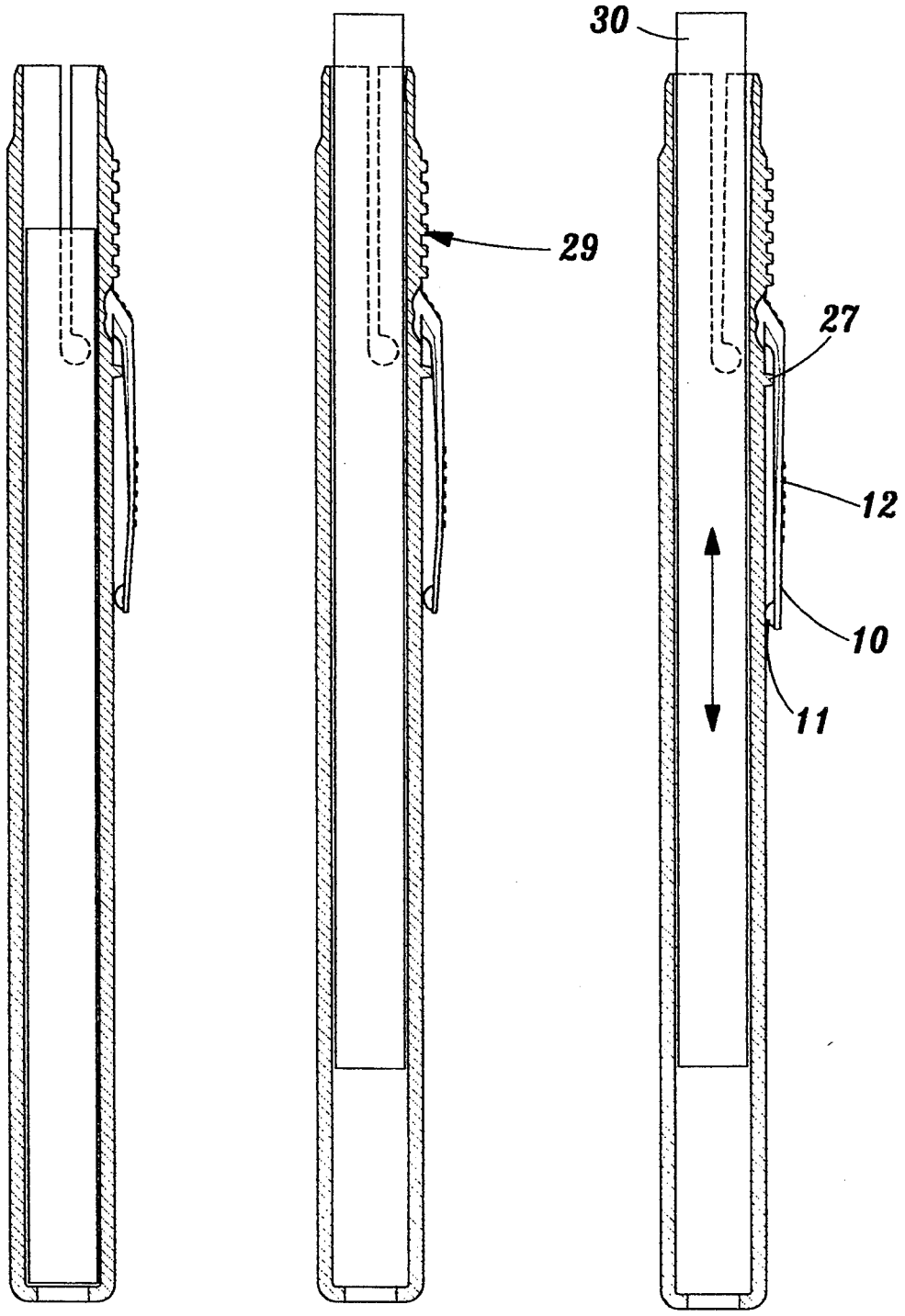
FIG. 3A is a sectional view showing the upper fissured end of the clamping tube expanded, and permitting a rod member therein to be moved inward/outward.
FIG. 3B shows the fissured end of the clamping tube contracted to tightly clamp the rod member.
FIG. 3C shows the rod member retrieved inside the clamping tube.

Please refer to FIGS. 3A, 3B and 3C which show the application of the present invention. When pressing down the clip member 10, the fissures 23 are expanded. At this time, the protruding length of the rod member 30 can be easily adjusted. After the adjustment is completed, the clip member 10 is released and the annular projections 29 of the clamping tube 20 are engaged to use the pen. At this time, the rod member 30 is prevented from being moved backward by external force. After use, the rod member 30 is retrieved into the clamping tube 20 and stored therein. At this time, the stopper block 28 and saw teeth 26 thereof stop and prevent the rod member 30 from dropping outside.

Figure 4:
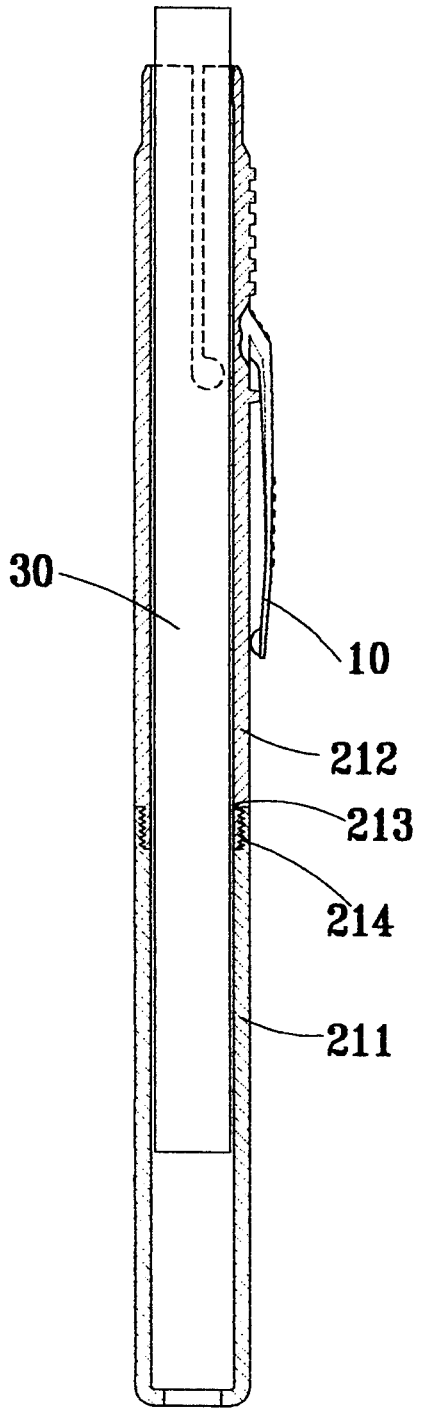
FIG. 4 is a sectional view showing another embodiment of the present invention.

FIG. 4 shows another embodiment of the present invention wherein the clamping tube 20 is divided into an upper and a lower sections 211, 212 which are detachably associated with each other by female and male threads 213, 214. Thus, the rod member 30 can be more easily placed into the clamping tube 20 in such a manner that the rod member 30 is first placed into the upper section 211 and then the lower section 212 is associated with the upper section 211. In case it is difficult to move the rod member 30 outward/inward, the upper and lower sections 211, 212 can be quickly disassembled to solve the problem.

In conclusion, the clamping pen of the present invention permits the rod member to be fully used up without waste and enables a user to conveniently and easily use the pen without difficulty.

It is to be understood that the above description and drawings are only used for illustrating preferred embodiments of the present invention, and are not intended to limit the scope thereof. Any variation and derivation from the above description and drawings should be included in the scope of the present invention.

What is claimed is:

1. A clamping pen comprising:

a) a hollow tube having an open upper end and a lower end for receiving a rod member therein;

b) a pair of slots extending axially inwardly from the open upper end and terminating in a pair of closed ends;

c) a resilient clip member having a first end secured to the tube and a free end;

d) a flange formed on the tube and positioned between the fixed end and free end of the clip member adjacent the closed ends for defining a fulcrum point engageable by the clip member; and e) whereby when the clip member is compressed towards the tube into engagement with the flange, the pair of slots are expanded for permitting the rod member to be moved inwardly or outwardly of the tube.

2. The clamping pen of claim 1 wherein the tube further includes a plurality of annular projections axially spaced therealong between the open upper end and the fixed end of the resilient clip member for engagement by a user to compress the slots and clamp the rod member within the tube.

3. The clamping pen of claim 1 wherein the interior of the tube adjacent the open upper end is provided with a substantially convex stopper block for compressing the rod member and increasing frictional force therebetween.

4. The clamping pen of claim 3 wherein the stopper block further includes a plurality of reverse saw teeth for engaging the rod member and preventing the rod member from being moved inwardly of tube.

5. The clamping pen of claim 3 wherein the interior of the tube adjacent the open upper end and the stopper block includes a portion having an inner diameter that is smaller than the outer diameter of the rod member for preventing the rod member from moving outwardly of the tube.

6. The clamping pen of claim 1 further including a hole formed in the tube between the slots for extruding a portion of the rod member through the hole and clamping the rod member within the tube.

7. The clamping pen of claim 1 further including a ventilation opening formed in the lower end of the tube for removing air resistance during movement of the rod member within the tube.

8. The clamping pen of claim 1 wherein the closed ends of the slots each define an enlarged portion of the slot and the enlarged portions being positioned between the first end of the clip member and the flange.

* * * * *